US005969743A

United States Patent [19]

Tanaka

[11] Patent Number: 5,969,743

[45] Date of Patent: Oct. 19, 1999

[54] THERMAL HEAD

[75] Inventor: Shiro Tanaka, Aira-gun, Japan

[73] Assignee: Kyocera Corporation, Kyoto, Japan

[21] Appl. No.: 08/918,036

[22] Filed: Aug. 25, 1997

[30] Foreign Application Priority Data

Aug. 30, 1996 [JP] Japan ..... 8-230696

[51] Int. Cl.[6] ..... B41J 2/335

[52] U.S. Cl. ..... 347/206; 347/200

[58] Field of Search ..... 347/200, 204, 347/206, 191

[56] References Cited

FOREIGN PATENT DOCUMENTS 4-197650 7/1992 Japan ..... 347/206

6-031964 2/1994 Japan ..... 347/206

*Primary Examiner*—Huan Tran

*Attorney, Agent, or Firm*—Loeb & Loeb LLP

[57] ABSTRACT

A thermal head comprises a number of heating elements arranged on an electrically insulating substrate as a straight line and a plurality of driver ICs which are electrically connected to the heating elements so as to control generation of heat at the respective heating elements, wherein electric resistance values of the respective heating elements are within a range of ±1.8% with respect to a reference value, and the electric resistance values of the respective heating elements are distributed in the form of a meandering shape. A maximum value of the distribution of the electric resistance values of the heating elements is set at +0.5% to +1.8% with respect to the reference value and a minimum value of the distribution is set at −0.5% to −1.8% with respect to the reference value. In this manner, it is possible to eliminate inconsistencies in density of the plurality of heating elements connected to the driver ICs and print an image of excellent quality.

8 Claims, 3 Drawing Sheets

THERMAL HEAD

BACKGROUND OF THE INVENTION

1. Field of the Invention

The present invention relates to an improvement to a thermal head which is used in a facsimile apparatus, a heat transfer printer, etc.

2. Description of the Related Art

A conventional thermal head has a structure in which an insulation substrate of alumina ceramics, for instance, seats a number of heating elements which are arranged as straight lines at a line density of 100 to 1,200 dpi (dot per inch) and a plurality of driver ICs (integrated circuits) which are electrically connected to the heating elements through a conductive layer or the like.

The driver ICs aim at selectively controlling heat generation in the plurality of heating elements which are respectively connected to the driver ICs in accordance with a printing signal which is supplied from outside, and therefore, a logic circuit such as a switching transistor, a latch and a shift register is formed inside each driver IC, and the same number of output terminals as the number of the heating elements whose heat generation is to be controlled by each IC are disposed to a mounting surface of each IC. The output terminals are electrically connected to the heating elements through the conductive layer or the like which is formed in a head substrate, so that each heating element develops Joule's heat when provided with an output current from the corresponding output terminal.

In such a thermal head, the heating elements selectively generate Joule's heat as driven by the driver ICs, the generated heat is transferred to a thermal recording medium such as a heat sensitive paper, and a printing image which corresponds to the printing signal is formed on the thermal recording medium.

A number of the heating elements are patterned by a sputtering method, a photolithographic technique or the like, in general, in such a manner that the respective heating elements have the same width and the same length with each other. Further, electric resistance values of the heating elements are adjusted at a high accuracy by a laser trimming method, a pulse trimming method or the like, and therefore, it is possible to ensure that the electric resistance values of the heating elements are exactly the same with each other.

However, in such a conventional thermal head described above, due to variations among the driver ICs caused during fabrication, internal resistance values which are inherent to switching transistors which are formed inside the driver ICs are somewhat different from each other among the driver ICs. Because of this, when generation of heat at a number of the heating elements is controlled using the plurality of driver ICs, an electric loss corresponding to the internal resistance of the switching transistor is created within each driver IC, so that the quantity of Joule's heat varies among the heating elements. As a result, a printing density varies among the plurality of heating elements which are connected to the driver ICs. Inconsistencies in density become noticeable particularly in an image such as a photograph of which is required to be finely expressed.

SUMMARY OF THE INVENTION

Hence an object of the invention is to provide a thermal head capable of realizing thermal recording of high quality with slight inconsistencies in density even when internal resistance values of switching transistor which are formed inside driver ICs vary among the driver ICs.

The invention provides a thermal head comprising a number of heating elements which are arranged as a straight line; and a plurality of driver ICs which are electrically connected to the heating elements so as to control generation of heat at the respective heating elements, wherein electric resistance values of the respective heating elements are within a range of ±1.8% with respect to a reference value, and the electric resistance values of the respective heating elements are distributed in the form of a winding shape.

According to the invention, as the electric resistance values of the respective heating elements are distributed in the form of a winding shape which changes periodically within a certain range, changes in density due to variations in the internal resistance values of the transistors are concealed by changes in density due to the distribution of the electric resistance values of the heating elements.

Further, while quality control of a cycle of the former changes in density is difficult since this cycle is random depending on variations among the ICs caused during fabrication, it is easy to adjust the latter changes in density to a desired cycle and amplitude of change by trimming the resistances of the elements, and therefore, it is possible to set the latter changes in density to a cycle and amplitude of change which are the most inconspicuous to vision of a human being. In this manner, the inconsistencies in density due to the variations among the ICs caused during fabrication are eliminated, and therefore, it is possible to print even an image which requires fine gradation such as a photograph, at an excellent quality.

Still further, in the invention it is preferable that a maximum value of the distribution of the electric resistance values of the heating elements is set at +0.5% to +1.8% with respect to the reference value and a minimum value of the distribution is set at −0.5% to −1.8% with respect to the reference value.

According to the invention, as the maximum value and the minimum value of the distribution of the electric resistance values of the heating elements are controlled respectively within the certain ranges, the amplitude of change in the distribution of the electric resistance values is guaranteed, and therefore, it is possible to eliminate the inconsistencies in density due to the variations among the ICs caused during fabrication without fail.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
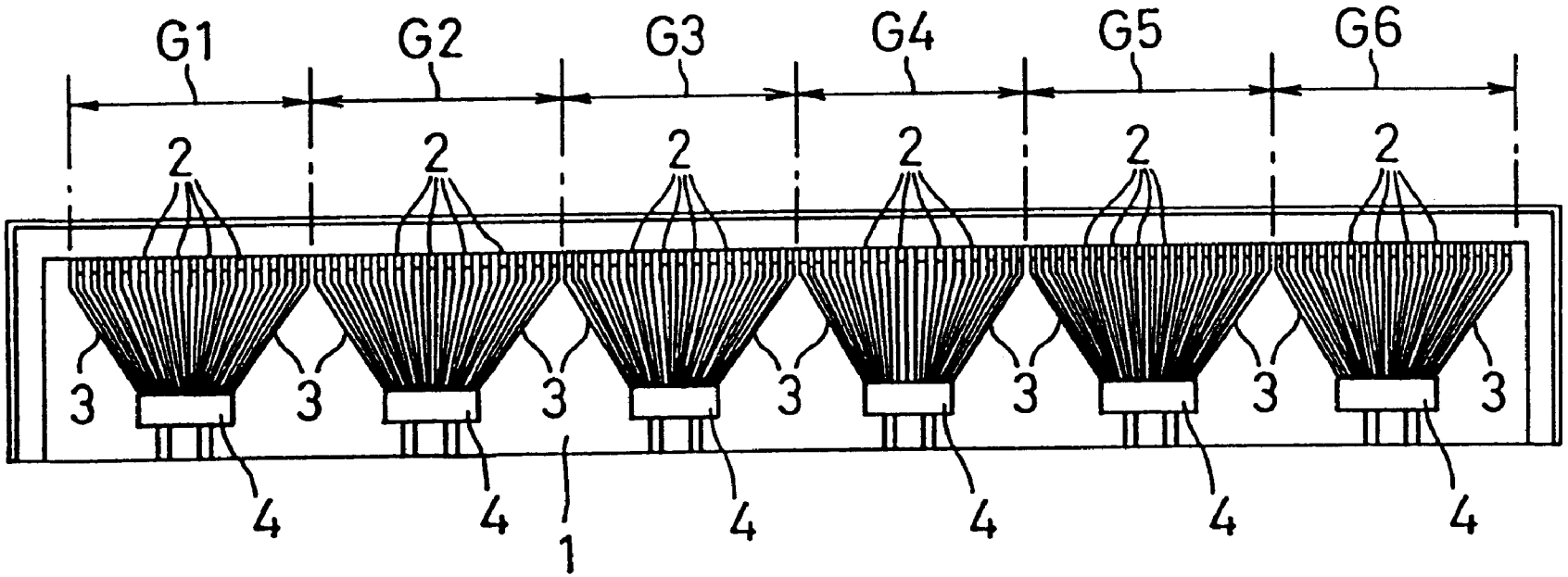
FIG. 1 is a plan view showing a preferred embodiment of a thermal head according to the invention.

Now referring to the drawings, preferred embodiments of the invention are described below.

FIG. 1 is a plan view showing a preferred embodiment of a thermal head according to the invention, wherein reference numeral 2 denotes heating elements and reference numeral 4 denotes driver ICs.

The thermal head shown in FIG. 1 is formed by mounting a number of heating elements 2, a number of conductive layers 3 which are respectively connected to the both edges of the heating elements 2, and a plurality of driver ICs 4 which are electrically connected to the plurality of heating elements 2 through the conductive layers 3 onto a top surface of an electrically insulating substrate 1 of alumina ceramics or the like.

Each heating element 2 has a predetermined rectangular shape, and the heating elements 2 are arranged as straight lines at a line density of 100 to 1,200 dpi. The heating elements 2 of tantalum nitride or the like themselves have a predetermined electric resistivity, and therefore, when provided with predetermined electric power through the conductive layers 3 from output terminals of the driver ICs 4, the heating elements 2 develop Joule's heat and reach a temperature, such as a temperature in the range of 200° C. to 350° C., which is needed to print an image on a thermal recording medium.

The heating elements 2 and the conductive layers 3 are patterned on the top surface of the insulating substrate 1 respectively into predetermined thicknesses (the heating elements 2 into the thickness of 0.01 to 0.5 $\mu$m, and the conductive layers 3 into the thickness of 0.5 to 2.0 $\mu$m) by a known method such as a sputtering method and a photolithographic technique.

In addition, the heating elements 2 are grouped into a plurality of groups G1 to G6 each consisting of a plurality of neighboring heating elements 2, and electrically connected to the respective driver ICs 4 by the groups G1 to G6.

The driver ICs 4 aim to selectively control heat generation in the plurality of heating elements 2 which are respectively connected to the corresponding driver ICs in accordance with a printing signal which is supplied from outside, and therefore, a logic circuit such as a switching transistor, a latch and a shift register is formed inside each driver IC 4, and the same number of output terminals as the number of the heating elements whose heat generation is to be controlled by each IC 4 are disposed to a mounting surface of each IC 4. As output currents from the output terminals are supplied to the heating elements 2 through the conductive layers 3, the plurality of heating elements 2 independently develop Joule's heat.

Further, electric resistance values of the respective heating elements 2 are within the range of ±1.8% of a reference value A, and the electric resistance values of the respective heating elements 2 are distributed in the form of a winding shape which regularly winds. The reference value A is an average value of the electric resistance values of all heating elements 2. For instance, when the reference value A is 1,000 Ω, the electric resistance values of the heating elements 2 are all within the range of 982 Ωto 1,018 Ω.

Now, the distribution of the electric resistance values of the heating elements 2 will be described with reference to FIGS. 2 to 5. FIGS. 2 to 5 shows the electric resistance values of the heating elements 2 as they are distributed in a winding shape, as graphs. In the graphs, axes of ordinates represent ratios of changes in electric resistance value to the reference value A. The electric resistance values of the plurality of heating elements 2 which belong to one group (G1 to G6) are plotted at the symbol mark ▲ from the left-hand side in the order in which the heating elements 2 are arranged, and the marks ▲ are linked to each other with a solid line, thereby establishing each graph.

Figure 2:
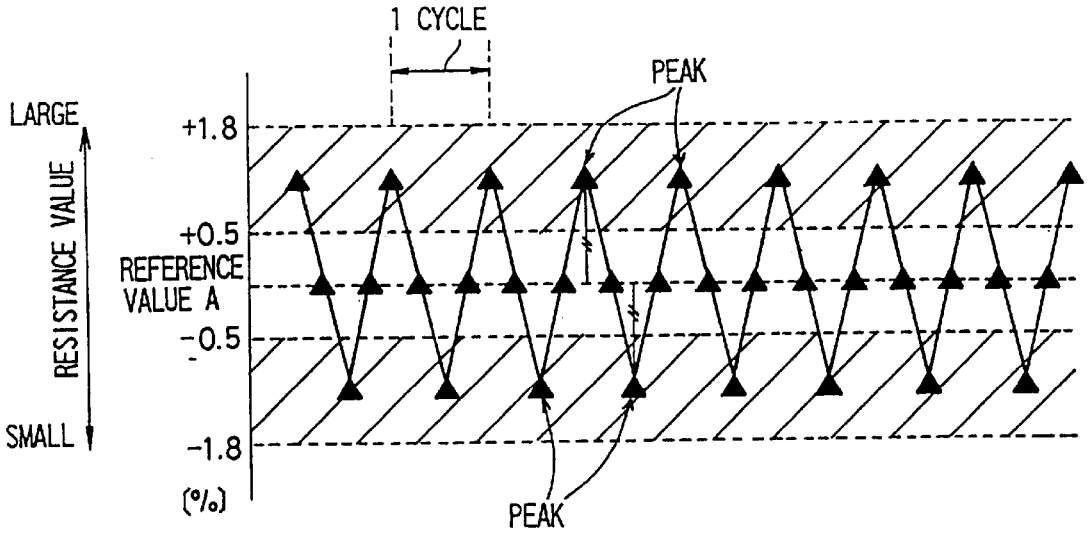
FIG. 2 is a graph showing an example of a distribution of electric resistance values of heating elements of a thermal head according to the invention.
Figure 3:
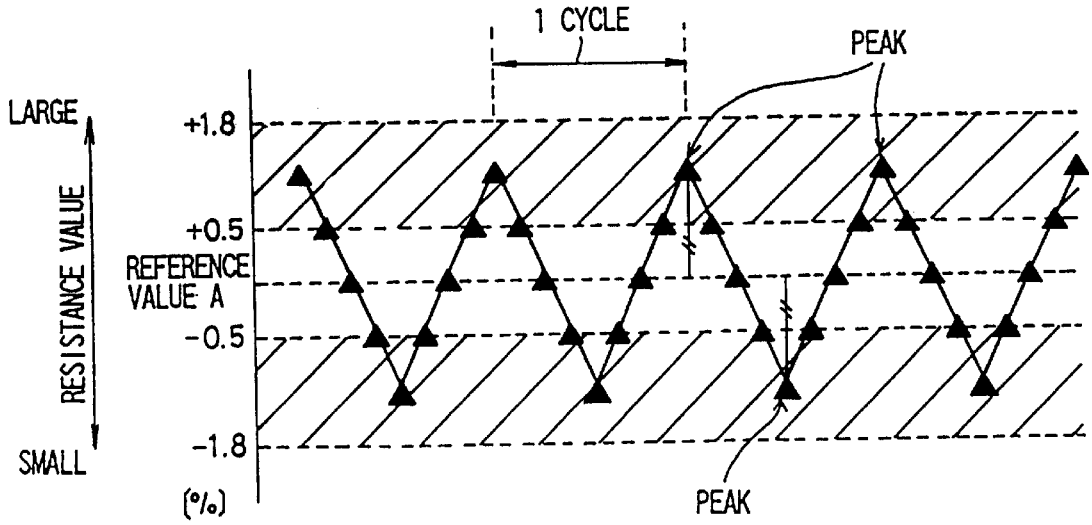
FIG. 3 is a graph showing another example of the distribution of electric resistance values of heating elements of a thermal head according to the invention.
Figure 4:
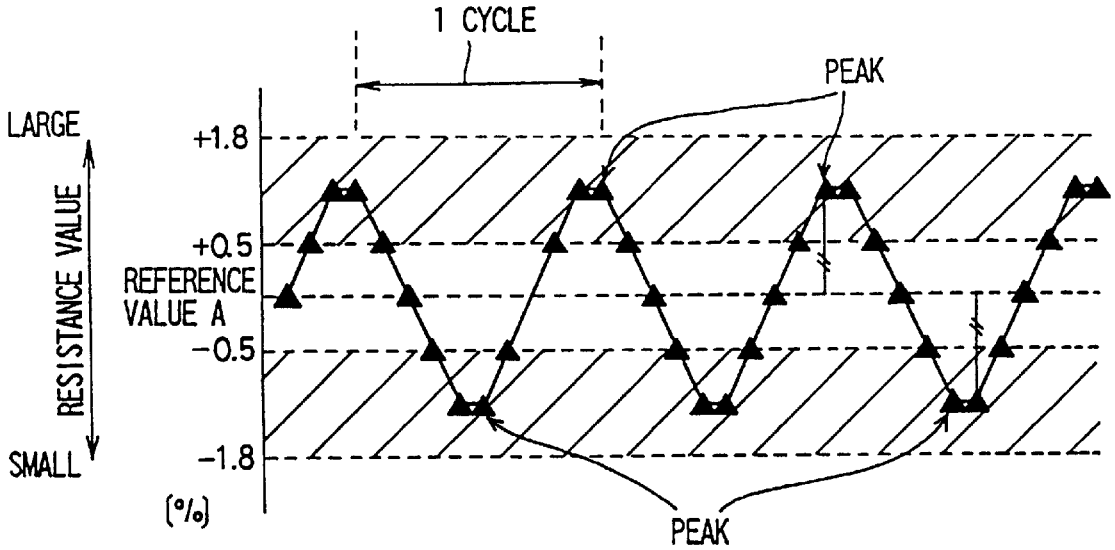
FIG. 4 is a graph showing still another example of the distribution of electric values of heating elements of a thermal head according to the invention.
Figure 5:
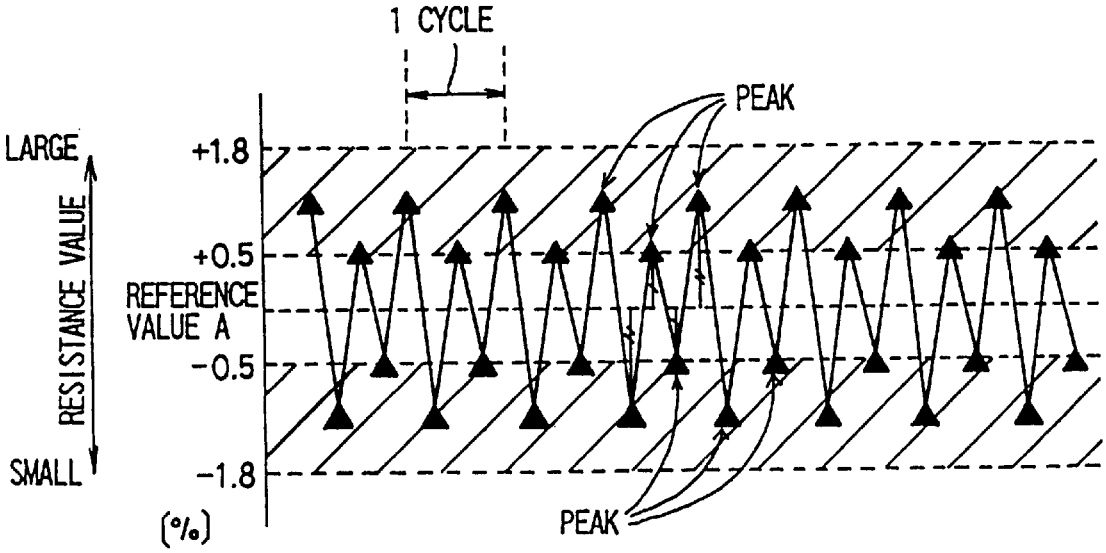
FIG. 5 is a graph showing yet another example of the distribution of electric values of heating elements of a thermal heads according to the invention.

As shown in FIGS. 2 to 5, the distribution of the electric resistance values of the heating elements 2 is set in such a manner that peaks which are above and below the reference value A are approximately equidistant from the reference value A, whereby the distribution manifests itself as a winding pattern in which the peaks regularly appear at a certain cycle. Such a winding pattern is formed by the plurality of heating elements 2 which are connected to the respective driver ICs 4, and various modifications of such a winding pattern are possible. For example, the winding pattern may be as shown in FIG. 2 wherein five of the heating elements 2 constitute one cycle, or may be as shown in FIG. 3 wherein nine of the heating elements 2 constitute one cycle, or may be as shown in FIG. 4 wherein the heating elements 2 having the same electric resistance values are linked to each other at the peaks, or may be as shown in FIG. 5 wherein two peaks having different values with respect to the reference value A are formed above and below the reference value A. In either case, inconsistencies in density among the plurality of heating elements which are connected to the respective driver ICs 4 is made inconspicuous, which in turn makes it possible to print even an image which must be expressed in fine gradation, such as a photograph, at an excellent quality.

Now, the effect of the invention will be described with reference to test results which are shown in Table 1.

TABLE 1

| Sample No. | Variation Range (%) | Inconsistency in Variation |
|---|---|---|
| No. 1 | −1.2 to +1.2 | not observed |
| No. 2 | −1.5 to +1.5 | not observed |
| No. 3 | −1.8 to +1.8 | not observed |
| No. 4 | −2.1 to +2.1 | slightly observed |
| No. 5 | −2.4 to +2.4 | slightly observed |
| No. 6 | no variation | observed |

Table 1 shows results of printing tests using thermal head samples No. 1 to No. 6. The thermal head samples No. 1 to No. 6 were each fabricated by arranging a number of heating elements on a top surface of an alumina substrate which includes a glaze layer at a line density of 300 dpi, connecting sixty four elements out of the heating elements to each driver IC to obtain six thermal heads, and thereafter trimming the heating elements of each thermal head under various conditions to adjust electric resistance values. The thermal head samples No.1 to No.5 were fabricated by varying the electric resistance values of all heating elements from the reference value A within various ranges, in such a manner that the electric resistance values are distributed in the form of a meandering pattern which includes two peaks having different values as that shown in FIG. 5. The thermal head sample No. 6 was fabricated by adjusting the electric resistance values of all heating elements so that the electric resistance values are approximately equal to each other. The reference value A was set to 1,000 Ω.

The results of the printing tests confirm that the samples No. 4 and No. 5 which were fabricated by varying the electric resistance values of the heating elements from the reference value A beyond a range of ±1.8% have slight inconsistencies in density due to the differences in the electric resistance values among the heating elements, and the sample No.6 in which the electric resistance values of all heating elements are equal to each other has inconsistencies in density among groups of sixty four heating elements which are connected to each driver IC, whereas the samples No. 1 to No. 3 in which the electric resistance values of the heating elements are within the range of ±1.8% and distributed in the form of a meandering pattern printed even an image which must be expressed in fine gradation, such as a photograph, at an excellent printing quality without an inconsistency in density.

From the foregoing, it is understood that when the electric resistance values of the respective heating elements 2 are set to be within the range of ±1.8% from the reference value A in such a manner that the electric resistance values of the respective heating elements 2 are distributed in the form of a meandering pattern, inconsistencies in density among groups of a plurality of heating elements which are connected to each driver IC 4 are not noticeable, and therefore, it is possible to print even an image which requires fine gradation such as a photograph, at an excellent printing quality.

Further, when the maximum value and the minimum value of the distributed electric resistance values of the heating elements 2 are set to be within a range of ±0.5% to ±1.8% from the reference value A, even where it is necessary to express gradation at an extremely high accuracy, e.g., in the case of an X-ray photograph, it is possible to form a sharp image without a density gradation at an extremely good quality. Hence, it is preferable to set the maximum value of the distributed electric resistance values of the heating elements 2 to be within a range of +0.5% to +1.8% and the minimum value of the distributed electric resistance values of the heating elements 2 set to be within a range of −0.5% to −1.8%.

As a method of adjusting the electric resistance values of the heating elements 2, a known method such as a pulse trimming method may be used. In a pulse trimming method, to adjust the electric resistance values of the heating elements 2 to be low, for example, pulsed power of 0.01 to 1 millisecond is applied to the heating elements 2, while to adjust the electric resistance values of the heating elements 2 to be high, pulsed power of 20 to 500 milliseconds is applied to the heating elements 2. By trimming the electric resistance values of all heating elements 2 in this manner, it is possible to adjust the respective electric resistance values of the heating elements 2 to be within the range of ±1.8% from the reference value A and distributed in the form of a meandering pattern.

The thermal head as described above selectively allows the heating elements to develop Joule's heat as the driver ICs drive, transfers the developed heat to a heat sensitive paper, and forms a predetermined printing image on the thermal recording medium, thereby functioning as a thermal head. The invention however is not limited to the preferred embodiment described above. Rather, various modifications, improvements and the like can be devised without departing from the scope of the invention. For example, while the preferred embodiment described above requires to adjust the electric resistance values of the heating elements 2 by the pulse trimming method, the electric resistance values of the heating elements 2 may be adjusted by a laser trimming method in which trimming is performed using a laser beam.

The invention may be embodied in other specific forms without departing from the sprit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A thermal head comprising:

a plurality of heating elements which are arranged in a straight line; and a plurality of driver ICs which are electrically connected to the heating elements so as to control generation of heat at the heating elements;

wherein electric resistance values of the heating elements are within a range of ±1.8% with respect to a reference value, and the electric resistance values of the heating elements are distributed in a periodically winding distribution pattern.

2. A thermal head of claim 1, wherein a maximum value of the distribution of the electric resistance values of the heating elements is set at +0.5% to +1.8% with respect to the reference value and a minimum value of the distribution of the electric resistance values of the heating elements is set at −0.5% to −1.8% with respect to the reference value.

3. A thermal head comprising:

an electrically insulating substrate;

a plurality of heating elements arranged in a straight line on the electrically insulating substrate; and a plurality of driver ICs which are electrically connected to the heating elements so as to control generation of heat at the heating elements, wherein the heating elements have electric resistance values that are distributed along the straight line in a periodically winding distribution pattern about a reference value.

4. A thermal head of claim 3, wherein the reference value is an average value of the electric resistance values of the heating elements.

5. A thermal head of claim 4, wherein the electric resistance values of the heating elements have peak values above and below the reference value wherein the peak values appear in a specified regular cycle.

6. A thermal head of claim 5, wherein the specified regular cycle consists of an equal number of heating elements.

7. A thermal head of claim 5, wherein a maximum value of the distribution of the electric resistance values of the heating elements is set at +0.5% to +1.8% with respect to the reference value and a minimum value of the distribution of the electric resistance values of the heating elements is set at −0.5% to −1.8% with respect to the reference value.

8. A thermal head of claim 3, wherein the electric resistance values of the heating elements are distributed to define a distribution pattern that periodically varies generally in a zigzag shape about the reference value in the arrangement direction.

* * * * *